United States Patent [19]

Green

[11] 4,270,366

[45] Jun. 2, 1981

[54] ROTATABLE MOUNTING FOR NECKLACE GEM STONE

[76] Inventor: James W. Green, P.O. Box 208, Roxboro, N.C. 27573

[21] Appl. No.: 147,556

[22] Filed: May 8, 1980

[51] Int. Cl.[3] ..... A44C 25/00; A44C 17/02

[52] U.S. Cl. ..... 63/2; 63/31

[58] Field of Search ..... 63/2, 31

[56] References Cited

U.S. PATENT DOCUMENTS

| | | | |
|---|---|---|---|
| 1,025,447 | 5/1912 | Blume | 63/31 |
| 2,194,379 | 3/1940 | Bicks | 63/2 |
| 3,170,311 | 2/1965 | Raphael | 63/2 |
| 4,052,864 | 10/1977 | Hofsaess | 63/31 |

FOREIGN PATENT DOCUMENTS

| | | | |
|---|---|---|---|
| 785074 | 5/1935 | France | 63/31 |
| 856072 | 3/1940 | France | 63/31 |

*Primary Examiner*—F. Barry Shay

*Attorney, Agent, or Firm*—Harvey B. Jacobson

[57] ABSTRACT

A necklace is provided including an elongated flexible support member for encircling the neck of a wearer and the support member includes a predetermined portion thereof adapted to overlie the central chest portion of the wearer. The predetermined portion includes structure defining a journal and an axially short shank extends and is rotatably received through the journal and includes first and second ends which extend in forward and rearward directions, respectively, when the support member is being worn as a necklace. A gem stone is mounted on the first end of the shank member and the second shank member end includes radially outwardly extending lever structure supported therefrom for frictional engagement with underlying clothing or skin of the wearer and thereby is operative to effect angular displacement of the shank member and the gem stone relative to the journal responsive to lateral displacement of the journal relative to the underlying clothing or skin with which the lever structure is engaged. The lever structure comprises a disc substantially concentric with the shank member and the side of the disc remote from the gem stone is concave.

9 Claims, 3 Drawing Figures

FIG. 1
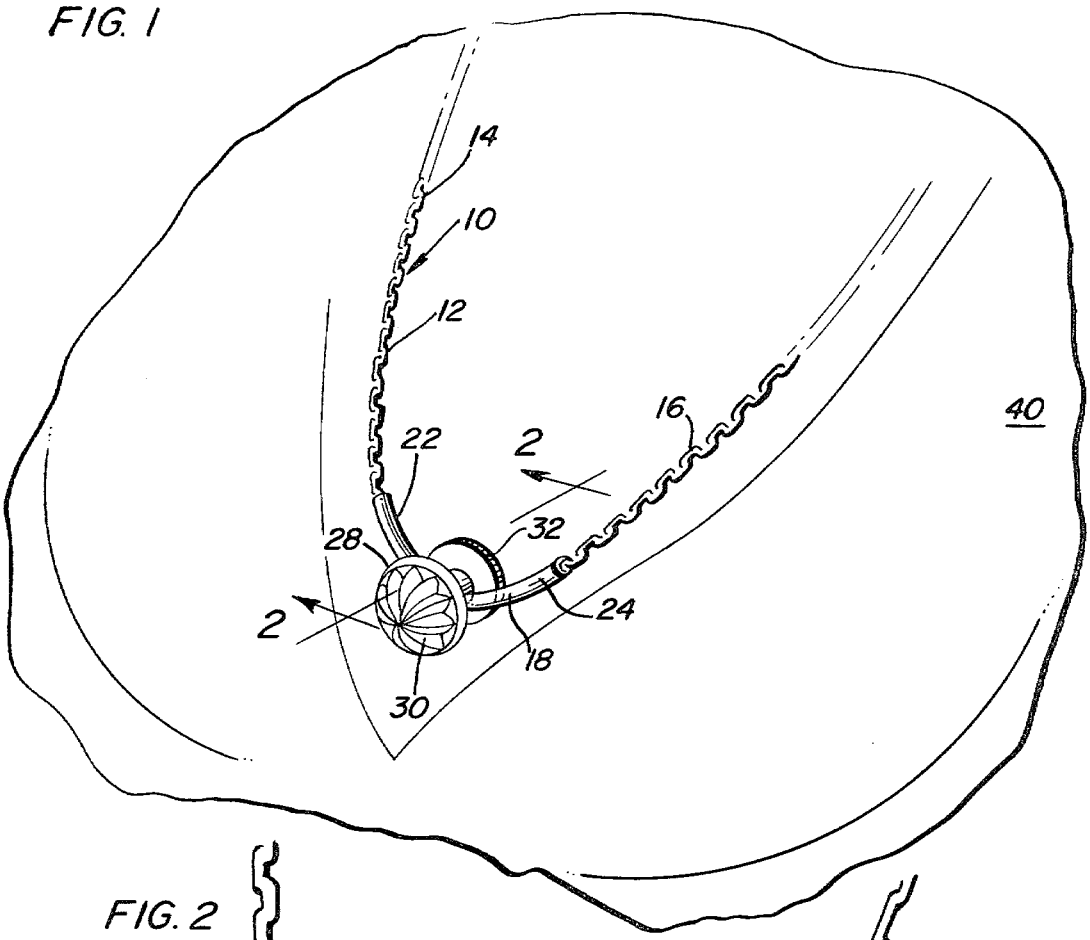
FIG. 2
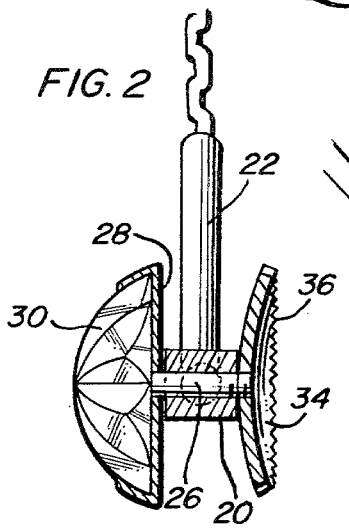
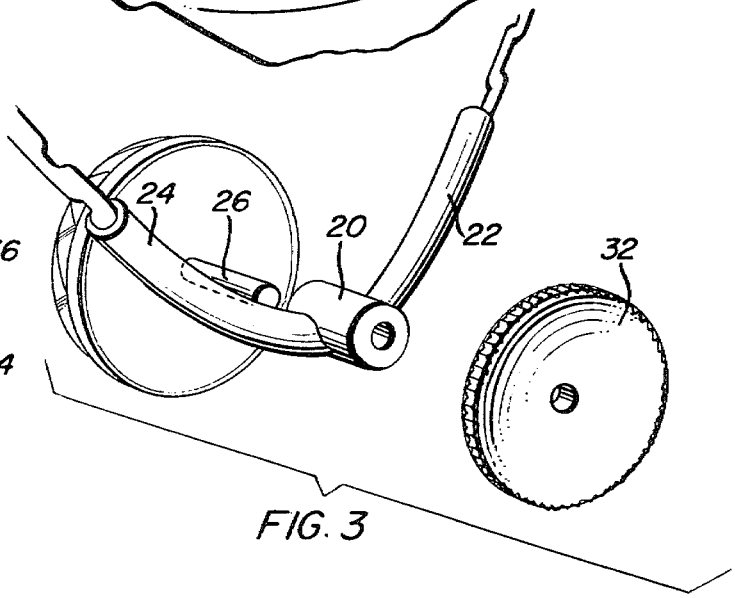
FIG. 3

ROTATABLE MOUNTING FOR NECKLACE GEM STONE

BACKGROUND OF THE INVENTION

Various gem stones include light reflecting capacities wherein the angular displacement relative to light incident thereon effects an attractive reflection of light to the viewer of the gem stone. Although various forms of mobile jewelry mounting mechanisms heretofore have been provided to enhance the appearance of jewelry, most of these mobile gem mounting structures have been large and cumbersome, or are not effective to produce movement of the associated gem stone as a result of slight normal body movements of the wearer of the gem stone.

Examples of various forms of mobile gem store mounting structures heretofore known are disclosed in U.S. Pat. Nos. 645,909, 915,678, 1,025,447, 2,190,778 and 4,052,864.

BRIEF DESCRIPTION OF THE INVENTION

The gem stone mounting structure of the instant invention is specifically designed to be utilized in conjunction with necklace-type or other similar jewelry. An elongated flexible support member is provided for encircling the neck of a wearer and including a predetermined portion thereof adapted to overlie the central chest portion of the wearer below the neck, as is conventional. The predetermined portion of the support member includes structure defining a journal and an axially short shank member extends and is rotatably received through the journal and includes first ad second ends adapted to extend in forward and rearward directions, respectively, when the support member is being worn as a necklace. Gem stone structure is mounted on the first end of the shank member and the second end of shank member includes a disc generally concentric with the shank member and whose side remote from the gem stone is concave, whereby the concave side of the disc rest upon clothing or underlying skin and lateral movement of the journal portion relative to the wearer of the necklace will cause the disc and thus the gem stone to be rotated relative to the journal.

The main object of this invention is to provide a gem stone mounting for a necklace which will be capable, upon slight movement of the wearer, to cause the gem stone to be angularly displaced relative to its mounting.

Another object of this invention is to provide a rotary gem stone mounting for a necklace and constructed in a manner whereby an associated gem stone may be angularly displaced relative to the mounting and thus variously reflect light incident thereon to the viewer.

Yet another object of this invention is to provide a rotary gem stone mounting for a necklace whose structure may be retained relatively small in order that even a small gem stone may be rotatably mounted therefrom without distracting from the aesthetic beauty of the gem stone.

A final object of this invention to be specifically enumerated herein is to provide a necklace equipped with a rotary gem stone mounting and which will conform to conventional forms of manufacture, be of simple construction and substantially automatic in operation when the associated necklace is worn so as to provide a device that will be economically feasible, long lasting and dependable in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of the a necklace constructed in accordance with the present invention;

FIG. 2 is an enlarged fragmentary vertical sectional view taken substantially upon the plane indicated by the section line 2—2 of FIG. 1; and FIG. 3 is an exploded perspective view of the rotary gem stone mounting structure.

DETAILED DESCRIPTION OF THE INVENTION

Referring now more specifically to the drawings, the numeral 10 generally designates a necklace constructed in accordance with the present invention. The necklace 10 includes an elongated flexible support member 12 having opposite end portions 14 and 16. The end portions 14 and 16 include adjacent ends between which a mount 18 is disposed and the other pair of ends of the end portions 14 and 16 include releasable catch structure (not shown) for releasably securing the end portions 14 and 16 together.

The mount 18 defines a journal sleeve 20 and a pair of elongated arms 22 and 24 which diverge outwardly from opposite sides of the journal sleeve 20. The free ends of the arms 22 and 24 remote from the sleeve 20 have the adjacent ends of the end portions 14 and 16 secured thereto in any convenient manner. An elongated short shank member 26 is provided and is rotatably received through the journal sleeve 20. One end of the shank member 26 supports a gem stone mount 28 therefrom and a gem stone 30 is supported from the mount 28. The second end of the shank member 26 has a lever disc 32 supported therefrom substantially concentric with the shank member 26. The side of the disc 32 remote from the gem stone 30 is concave as at 34 and the outer periphery of the disc 32 is slightly knurled or otherwise roughened as at 36.

If it is desired, the lever disc 32 could be replaced by a pendalum type lever, particularly if the gem stone or other light reflective jewelry item supported from the mount 28 is constructed so as to have a preferred upper side. Still further, the lever disc 32 could be in the form of a multi-pointed star or of other geometric shapes.

In operation, the necklace 10 is worn about the neck of the wearer 40 with the mount 18 and journal sleeve 20 overlying the lower central chest portion of the wearer 40. The shank member 26 extends in a front to rear direction and the lever disc 32 is carried by the rear end of the shank member 26 for opposing clothing overlying the chest of the user 40 or the skin of the chest of the user.

In operation, as the necklace is being worn, body movement of the user 40 tends to cause the journal structure 20 to swing in a pendulum fashion and the lever disc 32 to swing relative to the opposing clothing or skin surface. This, of course, will impart rotation to the disc 32 and thus rotate the gem stone 30.

It will, of course, be noted that the gem stone 30 may be a multi-faceted gem stone, but other gem stones and similar light reflective jewelry items may be supported from the mount 28.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A necklace including an elongated flexible support member for encircling the neck of a wearer and including a predetermined portion thereof adapted to overlie the central chest portion of the wearer below the neck, said predetermined portion including means defining a journal, an axially short shank member extending and rotatably received through said journal and including first and second ends adapted to extend in forward and rearward directions, respectively, when said support member is being worn as a necklace, gem stone means mounted on said first end of said shank member, the second end of said shank member including lever means comprising radially outwardly extending structure supported therefrom and adapted to frictionally engage opposing clothing or skin of the wearer and to thereby effect angular displacement of said shank member and said gem stone means relative to said journal responsive to lateral displacement of said predetermined portion relative to said underlying clothing or skin.

2. The necklace of claim 1 wherein said lever means comprises a disc-shaped body disposed generally normal to said shank member.

3. The necklace of claim 2 wherein said disc-shaped body is circular and generally concentric with said shank member.

4. The necklace of claim 3 wherein the side of said disc-shaped body remote from said gem stone means is concave.

5. The necklace of claim 1 wherein said predetermined portion comprises a rigid body interposed between and connecting adjacent ends of said adjacent sections of said support member.

6. The necklace of claim 5 wherein said rigid body includes a central portion defining said journal and a pair of diverging arms integral with said body and extending outwardly from said central portion, said adjacent ends of said sections of said support member being anchored relative to the outer ends of said arms.

7. The necklace of claim 6 wherein said lever means comprises a disc-shaped body disposed generally normal to said shank member.

8. The necklace of claim 7 wherein said disc-shaped body is circular and generally concentric with said shank member.

9. The necklace of claim 1 wherein said gem stone means includes a plurality of light reflecting and relatively angulated facets.

* * * * *